US008346458B2

(12) United States Patent
Midlam-Mohler et al.

(10) Patent No.: US 8,346,458 B2
(45) Date of Patent: Jan. 1, 2013

(54) COMPENSATING FOR RANDOM CATALYST BEHAVIOR

(75) Inventors: Shawn W. Midlam-Mohler, Columbus, OH (US); Sai S. V. Rajagopalan, Sterling Heights, MI (US); Kenneth P. Dudek, Rochester Hills, MI (US); Stephen Yurkovich, Columbus, OH (US); Yann G. Guezennec, Upper Arlington, OH (US)

(73) Assignee: GM Global Technology Operations LLC

( * ) Notice: Subject to any disclaimer, the term of this patent is extended or adjusted under 35 U.S.C. 154(b) by 450 days.

(21) Appl. No.: 12/714,854

(22) Filed: Mar. 1, 2010

(65) Prior Publication Data

US 2011/0082635 A1 Apr. 7, 2011

Related U.S. Application Data

(60) Provisional application No. 61/247,678, filed on Oct. 1, 2009.

(51) Int. Cl.
*F02D 43/04* (2006.01)

(52) U.S. Cl. ..... 701/104; 701/106; 701/109; 60/285

(58) Field of Classification Search ..... 701/104, 701/106, 109, 114, 115; 123/1 A, 27 GE, 123/525, 527, 672, 698, 699, 703; 60/276–278, 60/299, 285; 73/114.31, 114.52, 114.53, 73/114.72, 114.73, 114.69, 114.71, 114.75
See application file for complete search history.

(56) References Cited

U.S. PATENT DOCUMENTS

| | | | | | |
|---|---|---|---|---|---|
| 5,842,340 | A * | 12/1998 | Bush et al. | 60/274 |
| 5,847,271 | A * | 12/1998 | Poublon et al. | 73/114.73 |
| 5,848,528 | A * | 12/1998 | Liu | 60/274 |
| 5,996,337 | A * | 12/1999 | Blosser et al. | 60/274 |
| 6,055,963 | A * | 5/2000 | Brown et al. | 123/525 |
| 6,227,033 | B1 * | 5/2001 | Kainz | 73/23.32 |
| 6,289,673 | B1 * | 9/2001 | Tayama et al. | 60/285 |
| 6,405,527 | B2 * | 6/2002 | Suzuki et al. | 60/285 |
| 6,550,237 | B1 * | 4/2003 | Adamczyk et al. | 60/277 |
| 7,552,007 | B2 * | 6/2009 | Dudek | 701/115 |
| 2004/0040282 | A1 * | 3/2004 | Zhu | 60/276 |
| 2004/0060550 | A1 * | 4/2004 | Wu et al. | 123/694 |
| 2004/0261402 | A1 * | 12/2004 | Sealy et al. | 60/285 |
| 2005/0241297 | A1 * | 11/2005 | Wang et al. | 60/276 |
| 2009/0048766 | A1 * | 2/2009 | Dudek et al. | 701/109 |

* cited by examiner

*Primary Examiner* — John Kwon
*Assistant Examiner* — Johnny Hoang

(57) ABSTRACT

A method for calibrating an engine control module includes sampling a first signal from a first oxygen sensor located upstream from a catalyst. The first signal indicates an oxygen content of exhaust gas produced by an engine. The method further includes predicting a response of a second oxygen sensor located downstream from the catalyst using a model of the catalyst and the first signal and sampling a second signal from the second oxygen sensor. The method further includes determining a component of the second signal based on a difference between samples of the second signal and the predicted response. The component is due to gases other than oxygen. Additionally, the method includes calibrating the engine control module based on the component of the second signal. The engine control module controls an amount of fuel injected into the engine.

20 Claims, 8 Drawing Sheets

COMPENSATING FOR RANDOM CATALYST BEHAVIOR

CROSS-REFERENCE TO RELATED APPLICATIONS

This application claims the benefit of U.S. Provisional Application No. 61/247,678, filed on Oct. 1, 2009. The disclosure of the above application is incorporated herein by reference in its entirety.

FIELD

The present disclosure relates to emission control systems and methods, and more particularly to calibrating emission control systems and methods based on random catalyst behavior.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air/fuel (A/F) mixture within cylinders to drive pistons and generate drive torque. A ratio of air to fuel in the A/F mixture may be referred to as an A/F ratio. The A/F ratio may be regulated by controlling at least one of a throttle and a fuel control system. For example, the A/F ratio may be regulated to control torque output of the engine and/or to control emissions produced by the engine.

The fuel control system may include an inner feedback loop and an outer feedback loop. More specifically, the inner feedback loop may use data from an exhaust gas oxygen (EGO) sensor located upstream from a catalytic converter in an exhaust system (i.e., a pre-catalyst EGO sensor). The inner feedback loop may use the data from the pre-catalyst EGO sensor to control a desired amount of fuel supplied to the engine (i.e., a fuel command).

For example, the inner feedback loop may decrease the fuel command when the pre-catalyst EGO sensor senses a rich A/F ratio in exhaust gas produced by the engine. Alternatively, for example, the inner feedback loop may increase the fuel command when the pre-catalyst EGO sensor senses a lean A/F ratio in the exhaust gas. In other words, the inner feedback loop may maintain the A/F ratio at or near an ideal A/F ratio (e.g., 14.7:1 for gasoline engines).

The outer feedback loop may use information from an EGO sensor arranged after the catalytic converter (i.e., a post-catalyst EGO sensor). In some implementations, an EGO sensor may be positioned in other locations within the exhaust manifold. For example, EGO sensors may be placed within the catalytic converter (i.e., a mid-bed EGO). The outer feedback loop may use data from the post-catalyst EGO sensor to correct (i.e., calibrate) an unexpected reading from the pre-catalyst EGO sensor, the post-catalyst EGO sensor, and/or the catalytic converter. For example, the outer feedback loop may use the data from the post-catalyst EGO sensor to maintain the post-catalyst EGO sensor at a desired voltage level. In other words, the outer feedback loop may maintain a desired amount of oxygen stored in the catalytic converter since the post-catalyst sensor voltage level is related to catalyst efficiency and catalyst oxygen storage mass. This outer feedback loop thus improves the performance of the engine and catalyst system.

SUMMARY

A method for calibrating an engine control module comprises sampling a first signal from a first oxygen sensor located upstream from a catalyst. The first signal indicates an oxygen content of exhaust gas produced by an engine. The method further comprises predicting a response of a second oxygen sensor located downstream from the catalyst using a model of the catalyst and the first signal. The method further comprises sampling a second signal from the second oxygen sensor and determining a component of the second signal based on a difference between samples of the second signal and the predicted response. The component is due to gases other than oxygen. Additionally, the method comprises calibrating the engine control module based on the component of the second signal. The engine control module controls an amount of fuel injected into the engine.

A system for calibrating an engine control module comprises a catalyst simulation module, a component determination module, and a calibration module. The catalyst simulation module samples a first signal from a first oxygen sensor located upstream from a catalyst. The first signal indicates an oxygen content of exhaust gas produced by an engine. The catalyst simulation module also predicts a response of a second oxygen sensor located downstream from the catalyst using a model of the catalyst and the first signal. The component determination module samples a second signal from the second oxygen sensor and determines a component of the second signal based on a difference between samples of the second signal and the predicted response. The component is due to gases other than oxygen. The calibration module calibrates the engine control module based on the component of the second signal. The engine control module controls an amount of fuel injected into the engine.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
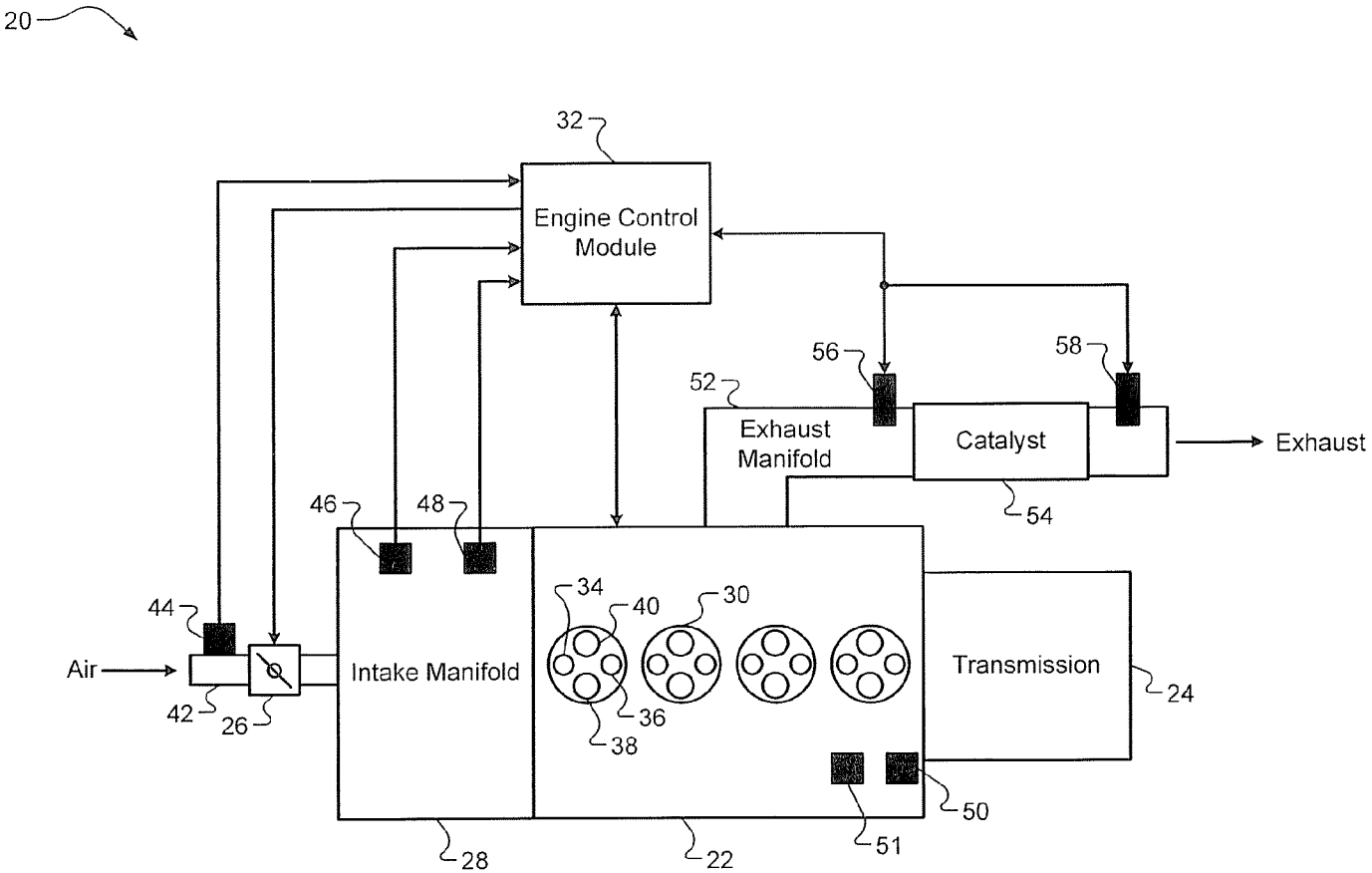
FIG. 1 is a functional block diagram of an engine system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

An engine control module may control an amount of fuel injected into cylinders of an engine based on feedback from oxygen sensors. Signals from the oxygen sensors indicate an oxygen content of exhaust gas. Accordingly, the engine control module may control the amount of fuel injected into the cylinders based on the oxygen content of the exhaust gas. However, an oxygen sensor downstream from a catalyst may be cross-sensitive to gases other than oxygen (e.g., hydrogen released from the catalyst). Accordingly, the oxygen sensor downstream from the catalyst may generate signals that indicate gases other than oxygen. Generation of signals by the oxygen sensor based on gases other than oxygen in the exhaust gas may be referred to as "sensor deception." The engine control module may incorrectly control the amount of fuel injected into the cylinders when the oxygen sensor downstream from the catalyst generates signals due to sensor deception.

A deception determination system according to the present disclosure may compensate for sensor deception. The deception determination system may characterize sensor deception as a random effect. More specifically, the deception determination system may implement a catalyst model that models sensor deception as a random effect (i.e., a random catalyst model). The deception determination system may calibrate a control architecture of the engine control module based on the random catalyst model. Accordingly, the engine control module calibrated based on the random catalyst model may correctly control the amount of fuel injected into the cylinders when the oxygen sensor downstream from the catalyst generates signals due to sensor deception.

Referring now to FIG. 1, an engine system 20 includes an engine 22 that drives a transmission 24. While a spark ignition engine is illustrated, compression ignition engines are also contemplated. A throttle 26 may regulate airflow into an intake manifold 28. Air within the intake manifold 28 is distributed into cylinders 30. An engine control module 32 actuates fuel injectors 34 to inject fuel into the cylinders 30. Each cylinder 30 may include a spark plug 36 for igniting the air/fuel (A/F) mixture. Alternatively, the A/F mixture may be ignited by compression in a compression ignition engine. Although FIG. 1 depicts four cylinders 30, the engine 22 may include additional or fewer cylinders 30. The engine 22 may also provide for an active fuel management system (not shown) that deactivates intake and exhaust valves 38, 40.

The engine control module 32 communicates with components of the engine system 20. Components of the engine system 20 include the engine 22, sensors, and actuators as discussed herein.

Air is passed from an inlet 42 through a mass airflow (MAF) sensor 44. The MAF sensor 44 generates a MAF signal that indicates a mass of air flowing into the intake manifold 28. A manifold pressure (MAP) sensor 46 is positioned in the engine intake manifold 28 between the throttle 26 and the engine 22. The MAP sensor 46 generates a MAP signal that indicates manifold absolute air pressure. An intake air temperature (IAT) sensor 48 located in the intake manifold 28 generates an IAT signal that indicates intake air temperature. An engine crankshaft (not shown) rotates at engine speed or a rate that is proportional to the engine speed. A crankshaft sensor 50 generates a crankshaft position (CSP) signal that may indicate the rotational speed and position of the crankshaft.

The engine 22 may include a cooling system that circulates an engine coolant. An engine coolant temperature (ECT) sensor 51 may generate an ECT signal that indicates engine coolant temperature. The ECT sensor 51 may be located within the engine 22 or at other locations where the engine coolant is circulated, such as a radiator (not shown).

The intake valve 38 selectively opens and closes to enable air to enter the cylinder 30. An intake camshaft (not shown) regulates a position of the intake valve 38. A piston (not shown) compresses the A/F mixture within the cylinder 30. The piston drives the crankshaft to produce drive torque. Combustion exhaust within the cylinder 30 is forced out through an exhaust manifold 52 when the exhaust valve 40 is in an open position. An exhaust camshaft (not shown) regulates a position of the exhaust valve 40. Although single intake and exhaust valves 38, 40 are illustrated, the engine 22 may include multiple intake and exhaust valves 38, 40 per cylinder 30.

The engine system 20 includes a catalyst 54 (e.g., a three way catalyst) that treats exhaust gas. The engine system 20 may include one or more oxygen sensors 56, 58 installed in the exhaust manifold 52. The oxygen sensor 56 upstream from the catalyst 54 may be referred to hereinafter as a "pre-cat sensor 56." The oxygen sensor 58 downstream from the catalyst 54 may be referred to hereinafter as a "post-cat sensor 58." The pre-cat and post-cat sensors 56, 58 may each generate a signal (e.g., a voltage) that indicates an amount of oxygen in the exhaust gas relative to an amount of oxygen in the atmosphere in addition to a signal component that is from deception from other gas species present in the exhaust. The signal generated by the pre-cat sensor 56 may be referred to hereinafter as a "pre-cat signal." The signal generated by the post-cat sensor 58 may be referred to hereinafter as a "post-cat signal."

While the engine system 20 is described as including pre-cat and post-cat sensors 56, 58, in some implementations, the engine system 20 may include EGO sensors that are positioned in other locations within the exhaust manifold 52. For example, EGO sensors may be placed within a catalytic converter of the exhaust manifold 52 (i.e., a mid-bed EGO).

The engine control module 32 receives input signals from the engine system 20. The input signals may include, but are not limited to, the MAF, MAP, IAT, CSP, ECT, pre-cat, and post-cat signals. The engine control module 32 processes the input signals and generates timed engine control commands that are output to the engine system 20. For example, engine control commands may actuate the throttle 26, the fuel injectors 34, and the spark plugs 36.

Figure 2:
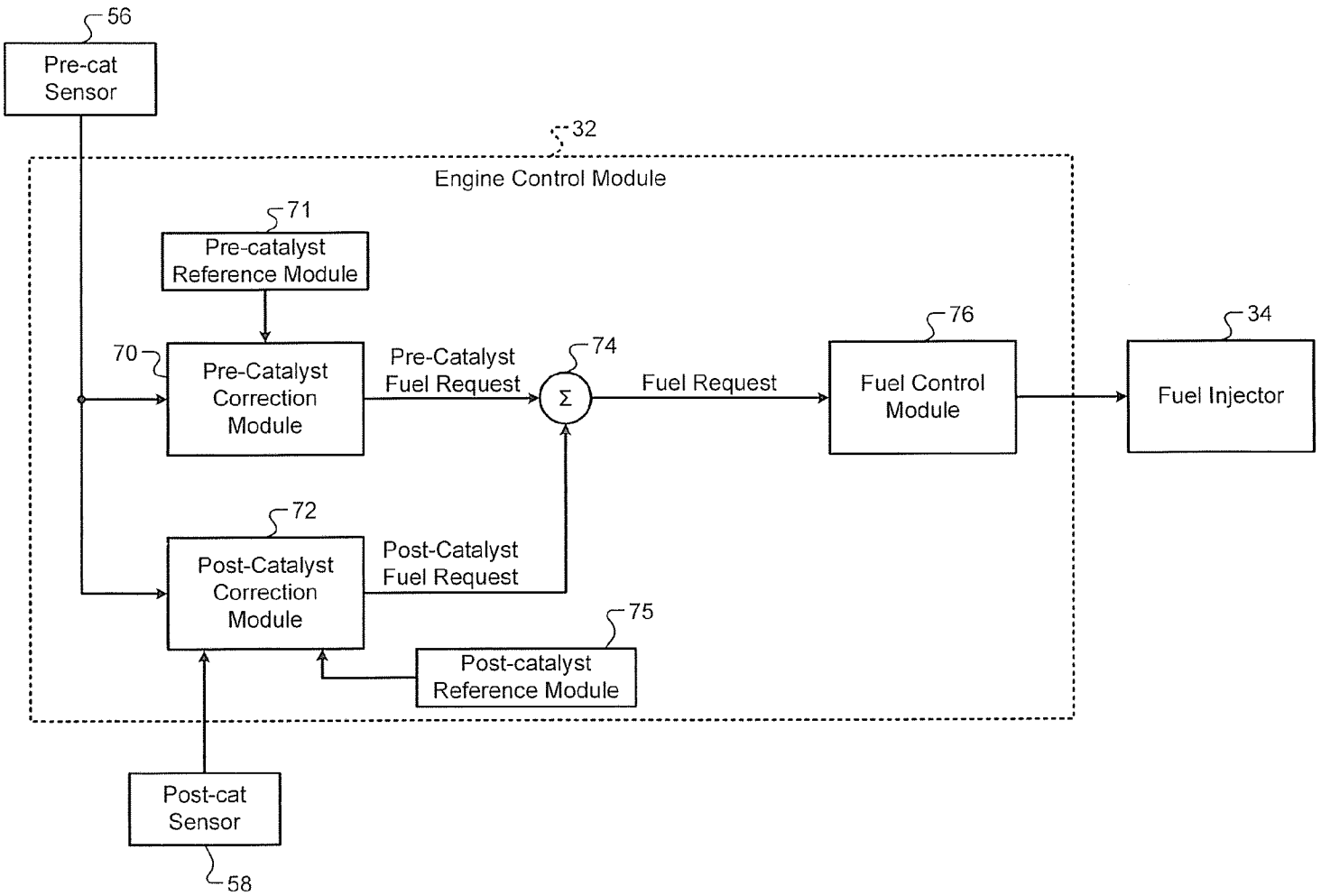
FIG. 2 is a functional block diagram of an engine control module according to the present disclosure.

Referring now to FIG. 2, an exemplary control architecture of the engine control module 32 is shown. The engine control module 32 includes a pre-catalyst correction module 70, a pre-catalyst reference module 71, a post-catalyst correction module 72, a compensation module 74, a post-catalyst reference module 75, and a fuel control module 76. The engine control module 32 may control an amount of fuel injected into the cylinders 30 based on feedback from the pre-cat and post-cat sensors 56, 58. In general, the engine control module 32 controls the amount of fuel injected into the cylinders 30 to control an A/F ratio of the A/F mixture combusted in the cylinders 30. For example, the engine control module 32 may control the A/F ratio in order to control emissions and performance of the engine system 20.

The fuel control module 76 controls an amount of fuel injected into the cylinders 30 based on a fuel request. The fuel request may indicate an amount of fuel to be injected into the cylinders 30 to control the engine system 20 to meet a desired emissions and/or performance level.

The fuel request may be based on a pre-catalyst fuel request and/or a post-catalyst fuel request. The pre-catalyst fuel request may indicate an amount of fuel requested to adjust the A/F ratio based on feedback from pre-cat signals. The post-catalyst fuel request may indicate an amount of fuel requested to adjust the A/F ratio based on feedback from post-cat signals. The compensation module 74 determines the fuel request based on the pre-catalyst fuel request and the post-catalyst fuel request.

The pre-catalyst correction module 70 may determine the pre-catalyst fuel request based on the pre-cat signals. The pre-catalyst correction module 70 may determine the pre-catalyst fuel request in order to maintain a desired A/F ratio. The desired A/F ratio may be an A/F ratio that achieves a desired emissions and/or performance level of the engine system 20. For example only, the desired A/F ratio may be near a stoichiometric ratio (e.g., 14.7:1 for gasoline engines). The pre-catalyst reference module 71 generates the desired A/F ratio.

The pre-catalyst correction module 70 may determine a current A/F ratio (i.e., a measured A/F ratio) based on the pre-cat signals. The pre-catalyst correction module 70 may determine the pre-catalyst fuel request based on a difference between the current A/F ratio and the desired A/F ratio. The pre-catalyst fuel request may represent an amount of fuel to be injected into the cylinders 30 in order to achieve the desired A/F ratio based on the pre-cat signals. For example, if the pre-cat signals indicate that the A/F ratio is rich and the desired A/F ratio is lean, the pre-catalyst correction module 70 may determine a pre-catalyst fuel request that reduces an amount of fuel injected in order to produce the desired lean A/F ratio. When the desired A/F ratio is near stoichiometric, the pre-catalyst correction module 70 may generate a pre-catalyst fuel request that switches between a lean A/F ratio and a rich A/F ratio.

The pre-cat signals may closely track the composition of the exhaust gas since the pre-cat sensor 56 is positioned to receive the exhaust gas directly from the cylinders 30 via the exhaust manifold 52. Accordingly, the pre-catalyst correction module 70 may make rapid corrections to the A/F ratio fuel via the pre-catalyst fuel request.

The post-catalyst correction module 72 may determine the post-catalyst fuel request based on the post-cat signals. The post-catalyst correction module 72 may generate the post-catalyst fuel request in order to maintain the desired A/F ratio. For example, the post-catalyst correction module 72 may generate the post-catalyst fuel request in order to maintain a desired post-cat signal (e.g., a signal that indicates the exhaust gas is near stoichiometric). The post-catalyst reference module 75 may generate the desired post-cat signal. The desired post-cat signal may also be based on a desired emissions and/or performance level.

The post-cat signals may not closely track the composition of the exhaust gas exhausted from the cylinders 30 since the post-cat sensor 58 is located after the catalyst 54. In other words, the catalyst 54 may have a buffering effect on the exhaust gas and may introduce a delay between when the exhaust gas is exhausted from the cylinders 30 and when the exhaust gas is measured at the post-cat sensor 58. Accordingly, the post-catalyst correction module 72 may make slower corrections to the A/F ratio.

The post-cat sensor 58 may be sensitive to gases other than oxygen. For example, the post-cat sensor 58 may be sensitive to hydrogen gas released from the catalyst 54. Accordingly, the post-cat sensor 58 may generate the post-cat signals based on an amount of hydrogen in the exhaust gas. The generation of post-cat signals based on gases other than oxygen in the exhaust gas may be referred to as "sensor deception." Oxygen sensors, either wide-range or switching, may generate signals due to sensor deception. The post-cat signal (i.e., voltage) may increase due to sensor deception. Accordingly, the engine control module 32 may determine that the A/F is richer or leaner when sensor deception occurs.

The engine control module 32 may include a control architecture such as proportional-integral-derivative (PID) control that includes gain values. For example only, the pre-catalyst correction module 70 and the post-catalyst correction module 72 may implement the control architecture and may include the gain values. As a further example, the control architecture may include one or more of gain-scheduled RD control, H∞ ("H-infinity") control, sliding mode control (SMC), and fuzzy logic control. Additionally or alternatively, other control architectures may be implemented.

The gain values included in the engine control module 32 may be determined based on a model-based calibration of the engine system 20. The model-based calibration may include determining the gain values of the control architecture based on measuring sensor values of the engine system 20 while operating the engine 22 over a range of operating conditions. For example, the model-based calibration may include determining the gain values based on pre-cat signals, post-cat signals, and a catalyst model. Model-based calibration may reduce calibration effort by decreasing a need for experimental work and reducing human interaction in the calibration process.

The catalyst model used to calibrate the control of the A/F ratio may output a predicted post-cat signal based on a pre-cat signal, exhaust flow, a temperature of the exhaust, etc. However, the catalyst model may not model sensor deception since modeling sensor deception may involve a computationally intensive model that may not be implemented efficiently in the engine control module 32. Accordingly, when the engine control module 32 is calibrated based on the catalyst model that does not account for sensor deception, the engine control module 32 may not correctly control fuel injection when sensor deception is present.

Calibration systems and methods according to the present disclosure characterize sensor deception of the post-cat sensor 58 and calibrate the engine control module 32 based on the characterization of the sensor deception. The calibration system characterizes the sensor deception as a random phenomenon. Accordingly, the calibration system calibrates the engine control module 32 to control the A/F ratio based on a characterization of the sensor deception as a random phenomenon.

Figure 3:
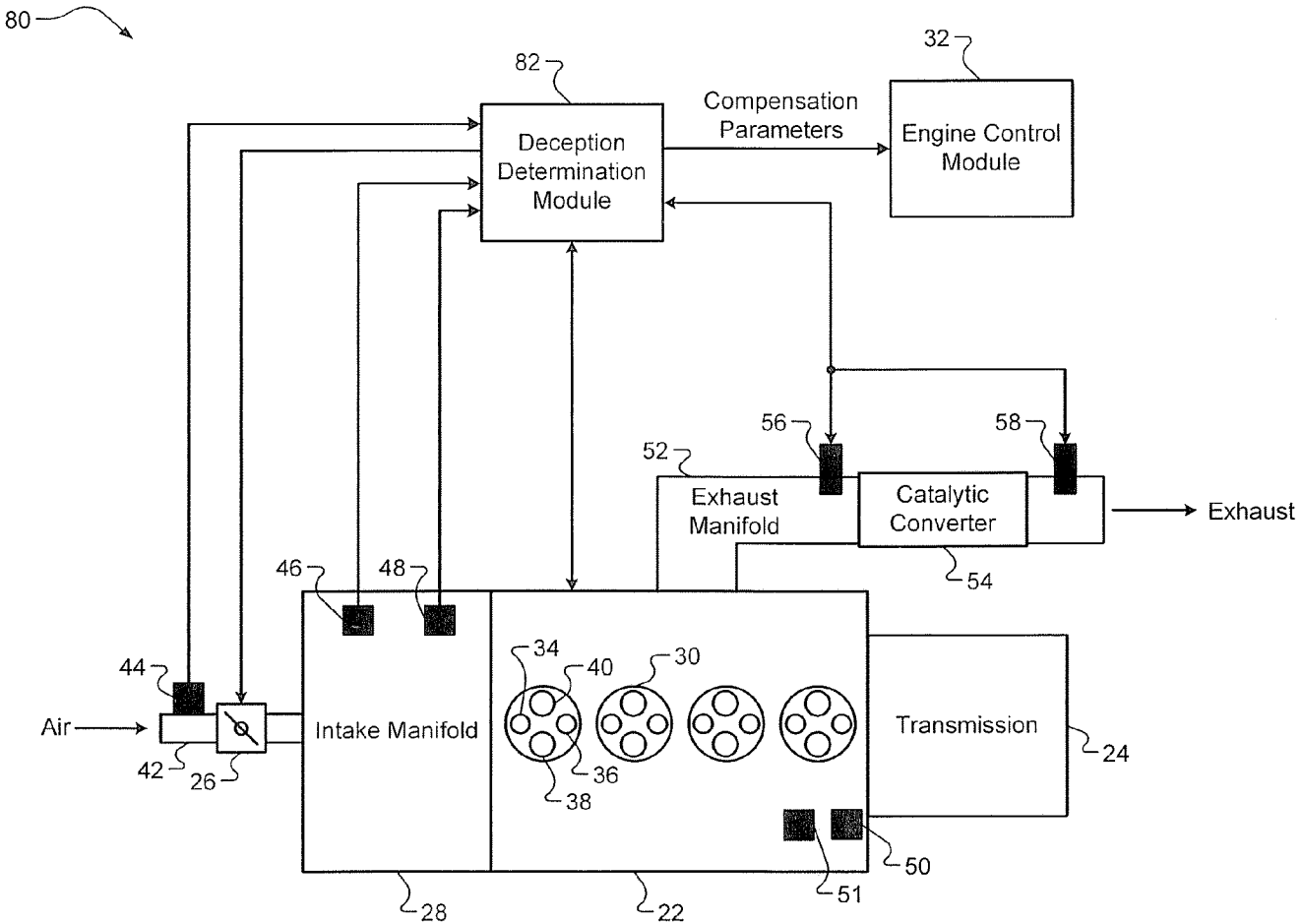
FIG. 3 is a functional block diagram of a deception determination system according to the present disclosure.

Referring now to FIG. 3, a deception determination system 80 determines compensation parameters used in the engine control module 32 to compensate for sensor deception. The compensation parameters may include gain values used, for example, in the post-catalyst correction module 72. In other words, the engine control module 32 may be calibrated based on the compensation parameters to correctly control fuel injection in the presence of sensor deception.

The deception determination system 80 includes a deception determination module 82. The deception determination module 82 may operate the deception determination system 80 in a similar manner as the engine control module 32. For example, the deception determination module 82 may control actuators of the deception determination system 80 based on signals received from sensors of the deception determination system 80. The deception determination module 82 may determine the compensation parameters based on pre-cat signals, post-cat signals, and the catalyst model. The deception determination module 82 may also determine the compensation parameters based on additional signals, including, but not limited to, MAF, MAP, IAT, CSP, and ECT signals. The deception determination module 82 may operate the engine 22 and associated components, for example, in a test bed setup and/or during driving cycles (e.g., federal test procedure (FTP) driving cycles). Accordingly, the deception determination module 82 may determine the compensation parameters based on data collected in the test bed and/or a driving test.

The deception determination module 82 may control the fuel injectors 34 based on the catalyst model. The deception determination module 82 may determine the compensation parameters based on comparison of a simulated post-cat signal, based on the catalyst model, and the measured post-cat signal.

Figure 4:
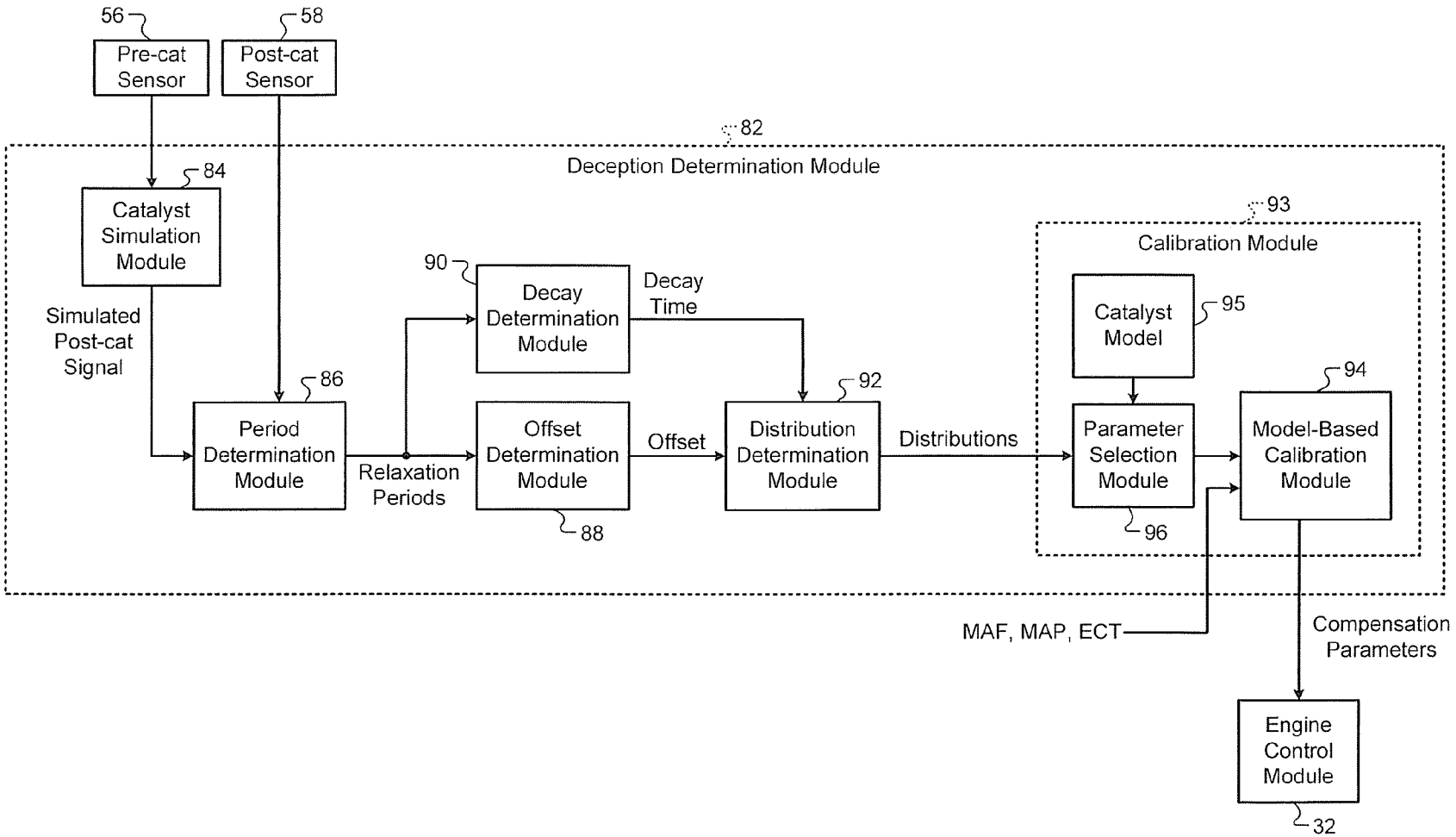
FIG. 4 is a functional block diagram of a deception determination module according to the present disclosure.

Referring now to FIG. 4, the deception determination module 82 includes a catalyst simulation module 84, a period determination module 86, an offset component determination module 88 (hereinafter "an offset determination module 88"), a decay component determination module 90 (hereinafter "a decay determination module 90"), a distribution determination module 92, and a calibration module 93.

The catalyst simulation module 84 may include the catalyst model that models operation of the catalyst 54. Accordingly, the catalyst simulation module 84 may simulate the post-cat signal. The post-cat signal simulated by the catalyst model may be referred to hereinafter as a "simulated post-cat signal." The simulated post-cat signal may indicate the actual exhaust gas composition at the post-cat sensor 58.

The period determination module 86 may receive the post-cat signals from the post-cat sensor 58 (i.e., measured post-cat signals) that may include a sensor deception component. The period determination module 86 determines periods of time during which the post-cat sensor 58 is generating signals due to sensor deception based on a comparison of the measured post-cat signal and the simulated post-cat signal. The periods during which the post-cat sensor 58 is generating signals due to sensor deception may be called "relaxation periods." The offset determination module 88 and the decay determination module 90 characterize the amount of sensor deception during the relaxation periods.

Figure 5:
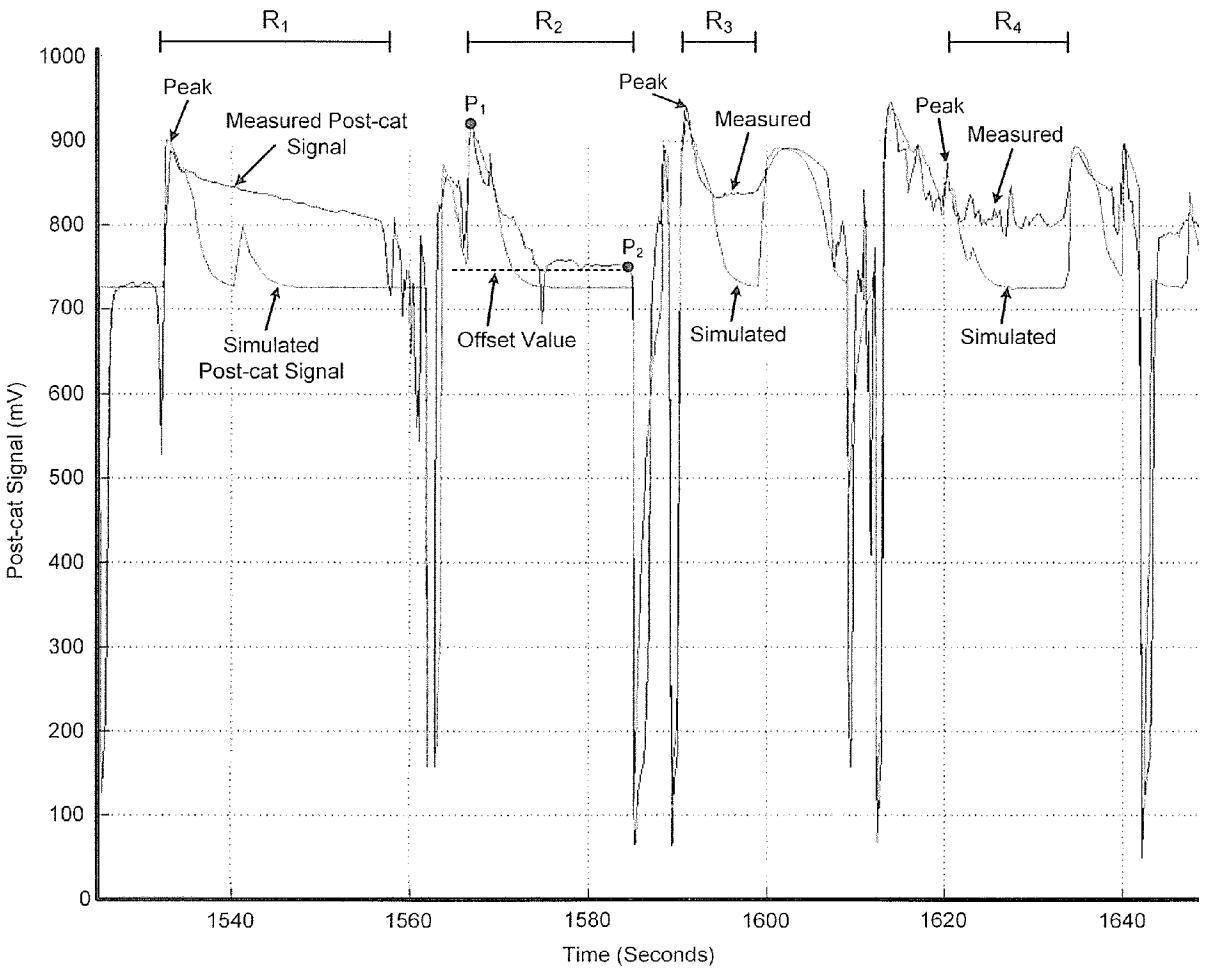
FIG. 5 is a graph that illustrates a comparison between a measured post-catalyst signal and a simulated post-catalyst signal according to the present disclosure.

Referring now to FIG. 5, the measured post-cat signal, simulated post-cat signal, and relaxation periods are shown. The period determination module 86 detects relaxation periods based on a comparison of the simulated post-cat signal and the measured post-cat signal. The relaxation periods in FIG. 5 are labeled $R_1$-$R_4$. During a relaxation period, the measured post-cat signal is greater than the simulated post-cat signal. For example, during relaxation period $R_1$, the measured post-cat signal is greater than the simulated post-cat signal. At the start of relaxation period $R_1$, the measured post-cat signal and the simulated post-cat signal are nearly equal in value. The start of relaxation period $R_1$ is labeled as "peak." The measured post-cat signal may not follow the simulated post-cat signal when the simulated post-cat signal decreases from the peak. Accordingly, calibrating the engine system 20 using the catalyst model that produces the simulated post-cat signal may result in incorrect control of fuel injection since the catalyst model may not predict a correct post-cat signal when there is sensor deception.

The period determination module 86 may detect a relaxation period when the measured post-cat signal decays at a slower rate than the simulated post-cat signal after a peak. The decay determination module 90 and the offset determination module 88 may characterize the amount of sensor deception based on the decay after the peak.

Sensor deception may be characterized by a time based component and an offset value. The decay determination module 90 may determine the time based component of the sensor deception during each relaxation period. For example, the time based component of the sensor deception may indicate a rate of decay of the measured post-cat signal during the relaxation period. The time based component may be referred to hereinafter as a "decay time." The offset determination module 88 may determine the offset value of the sensor deception during each relaxation period. The offset value may be the value that the measured post-cat signal decays towards during the relaxation period.

While sensor deception is characterized by a time based component and an offset value, other characterizations (i.e., dynamic representations) of sensor deception are contemplated. For example, higher order filters, multiple time based components, and/or multiple offset values may be used to characterize sensor deception.

An exemplary calculation of a decay time and an offset value will now be discussed in regard to relaxation period $R_2$. Relaxation period $R_2$ spans from a peak $P_1$ to a point $P_2$. The offset determination module 88 may determine the offset value based on a settling value of the measured post-cat signal. For example, the offset value may be equal to the settling value. In other words, the offset value may be described as an asymptotic value to which the measured post-cat signal decays to when the post-cat sensor 58 experiences sensor deception.

The decay determination module 90 may determine the decay time in relaxation period $R_2$ based on a decay function that connects the peak $P_1$ to point $P_2$. The decay determination module 90 may determine the decay time based on various decay functions. For example only, the decay determination module 90 may fit a first order decay function to the measured post-cat signal between peak $P_1$ and point $P_2$. The decay determination module 90 may determine the decay time based on a time constant of the first order decay function. For example only, the decay determination module 90 may determine that the decay time is equal to the time constant of the first order decay function. While the decay determination module 90 is described as determining the decay time of relaxation period $R_2$ based on a first order decay function, the decay determination module 90 may determine the decay time based on other functions (e.g., second order decay functions).

The deception determination module 82 may operate the engine 22 over a drive cycle to determine the compensation parameters. For example, the drive cycle may include an FTP drive cycle. The period determination module 86 may determine a plurality of relaxation periods during the drive cycle. The decay determination module 90 may determine a plurality of decay times corresponding to the plurality of relaxation periods determined during the drive cycle. The offset determination module 88 may determine a plurality of offset values corresponding to the plurality of relaxation periods determined during the drive cycle. The distribution determination module 92 may store the offset values and decay times determined during the plurality of relaxation periods.

The decay times and the offset values may vary amongst the relaxation periods depending on engine operating conditions. The decay times and offset values may not be accurately predicted based on the operating conditions. Accordingly, sensor deception may be modeled as a random phenomenon.

Figure 6B:
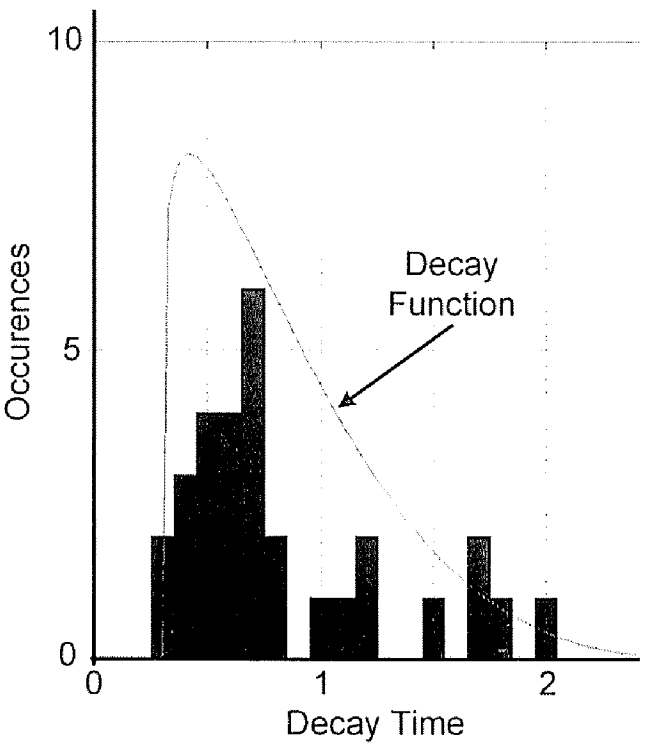
FIG. 6B illustrates a distribution of decay times based on the comparison between the measured post-catalyst signal and the simulated post-catalyst signal according to the present disclosure.
Figure 6A:
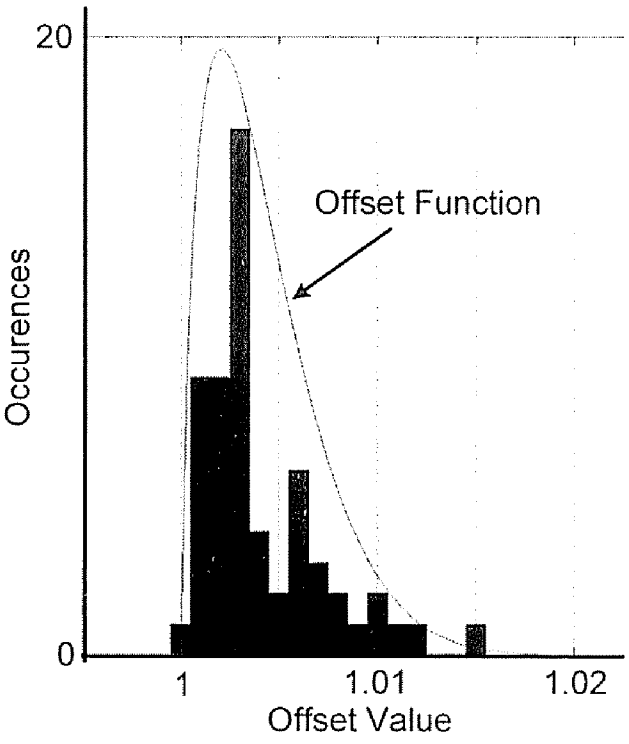
FIG. 6A illustrates a distribution of offset values based on the comparison between the measured post-catalyst signal and the simulated post-catalyst signal according to the present disclosure.

Referring now to FIGS. 6A-6B, the distribution determination module 92 may determine a distribution of the offset values and the decay times. An exemplary offset distribution function (hereinafter "offset function") is shown in FIG. 6A. The offset function may be based on a number of occurrences of a particular offset value. For example, in FIG. 6A, the offset value may be ratio of the measured post-cat signal to the simulated post-cat signal after the measured post-cat signal has reached an asymptotic value. The offset function may be a curve fitted to a histogram that includes the number of occurrences corresponding to various offset values.

An exemplary decay distribution function (hereinafter "decay function") may be based on a number of occurrences of a particular decay time. For example, in FIG. 6B, the decay time may be a time constant corresponding to a first order decay function that characterizes the decay of the measured post-cat signal during a corresponding relaxation period. For example only, a larger time constant value may correspond to a longer decay time. The decay function of FIG. 6B may be a curve fitted to a histogram that includes the number of occurrences corresponding to various decay times.

Referring back to FIG. 4, the calibration module 93 includes a model-based calibration module 94, a catalyst model 95, and a parameter selection module 96. The calibration module 93 may determine the compensation parameters based on the distributions of the decay times and the offset values. The compensation parameters may be gain values implemented in the control architecture of the engine control module 32 (e.g., the post-catalyst correction module 72). The calibration module 93 may perform a calibration of the control architecture of the engine control module 32 based on data acquired during a drive cycle (e.g., MAF, MAP, ECT, etc.) and a catalyst model that is modified by the distributions of the decay times and the offset values. The catalyst model that has been modified by the distributions of the decay times and the offset values may be referred to hereinafter as a "random catalyst model."

The parameter selection module 96 may modify the output (i.e., simulated post-cat signal) of the catalyst model 95 using the distributions. The catalyst model 95 may be the same catalyst model used in the catalyst simulation module 84 (i.e., the catalyst model that does not model sensor deception). For example, the parameter selection module 96 may adjust the simulated post-cat signal based on a selection of decay times and offset values in order to simulate the measured post-cat signal that includes sensor deception. In other words, the parameter selection module 96 may cause a simulated post-cat signal from the catalyst model 95 to decay to various offset values at various rates based on the decay time and offset value selected.

The parameter selection module 96 may select the decay times and the offset values to implement based on the decay function and the offset function, respectively. For example, the parameter selection module 96 may randomly select the decay times and offset values to implement. The parameter selection module 96 may select the decay times and the offset values based on a number of occurrences of the decay times and the offset values, respectively. For example, the parameter selection module 96 may select a decay time more often when the number of occurrences associated with that delay time is greater.

The model-based calibration module 94 may determine gain values for the control architecture (i.e., compensation parameters) of the engine control module 32 that compensate for sensor deception based on a calibration of the gain values using the random catalyst model. Accordingly, the engine control module 32 may control the engine system 20 based on the compensation parameters determined using the random catalyst model in order to provide robust control of the engine system 20 in the presence of sensor deception.

The compensation parameters are dependent on components of the engine system 20. For example, a change in the transmission 24 (e.g., automatic to manual) and/or a change in the engine 22 (e.g., displacement, type of fuel injection) may result in a different set of compensation parameters determined during the model-based calibration. Accordingly, the compensation parameters determined for a particular engine system may be tailored to fit that particular engine system.

Figure 7:
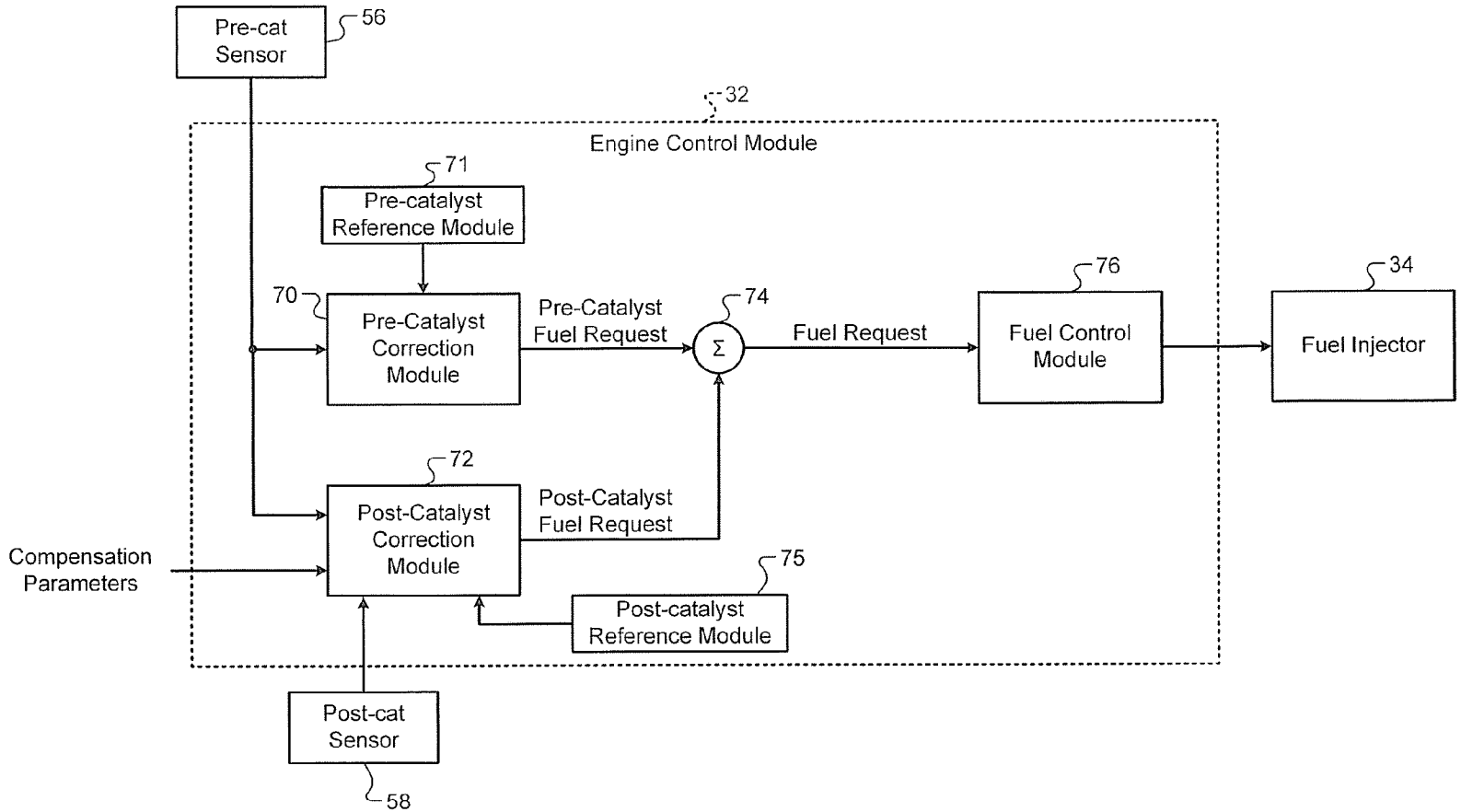
FIG. 7 is a functional block diagram of the engine control module including the compensation parameters according to the present disclosure.

Referring now to FIG. 7, the engine control module 32 may control the engine system 20 based on the compensation parameters determined using the random catalyst model. For example, the compensation parameters may be implemented in the control architecture of the post-catalyst correction module 72 as gains in a proportional-integral-derivative control architecture. In other words, the compensation parameters are used as gains in a control architecture (e.g., proportional-integral-derivative control architecture) to operate on the difference between the measured post-cat signal from the post-cat sensor 58 and the desired post-cat signal.

Figure 8:
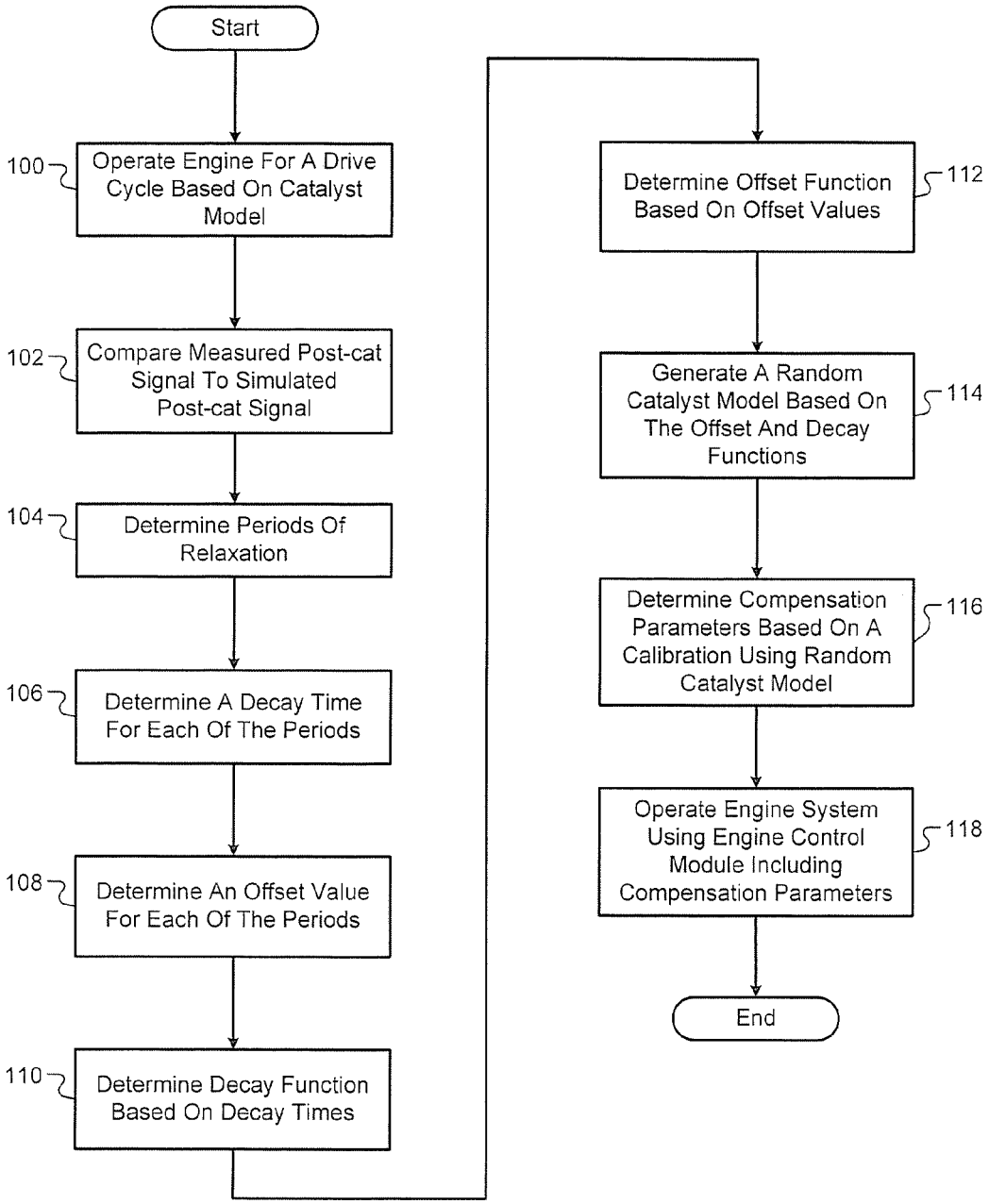
FIG. 8 is a flow diagram that illustrates a method for controlling the engine system based on a random catalyst model according to the present disclosure.

Referring now to FIG. 8, a method for controlling an engine system based on a random catalyst model starts at 100. At 100, the deception determination module 82 operates the engine 22 for a drive cycle based on a catalyst model. At 102, the period determination module 86 compares the measured post-cat signal to the simulated post-cat signal during the drive cycle. At 104, the period determination module 86 determines periods of relaxation corresponding to the drive cycle. At 106, the decay determination module 90 determines a decay time for each of the relaxation periods. At 108, the offset determination module 88 determines an offset value for each of the relaxation periods. At 110, the distribution determination module 92 determines a decay function based on the decay times. At 112, the distribution determination module 92 determines an offset function based on the offset values. At 114, the model-based calibration module 94 generates a random catalyst model based on the offset and decay functions. At 116, the model-based calibration module 94 determines compensation parameters based on a calibration using the random catalyst model. At 118, the engine control module 32 controls the engine system 20 based on the compensation parameters.

The broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A method for calibrating an engine control module, comprising:

sampling a first signal from a first oxygen sensor located upstream from a catalyst, wherein the first signal indicates an oxygen content of exhaust gas produced by an engine;

predicting a response of a second oxygen sensor located downstream from the catalyst using a model of the catalyst and the first signal;

sampling a second signal from the second oxygen sensor;

determining a component of the second signal based on a difference between samples of the second signal and the predicted response, wherein the component is due to gases other than oxygen; and calibrating the engine control module based on the component of the second signal, wherein the engine control module controls an amount of fuel injected into the engine.

2. The method of claim 1, wherein the gases other than oxygen include hydrogen gas.

3. The method of claim 1, wherein the gases other than oxygen include unburned hydrocarbons.

4. The method of claim 2, wherein the hydrogen gas is released from the catalyst.

5. The method of claim 1, further comprising calibrating a control architecture of the engine control module, wherein the control architecture includes at least one of proportional-integral-derivative (PID) control, gain-scheduled PID control, H-infinity control, sliding mode control (SMC), and fuzzy logic control.

6. The method of claim 1, further comprising:

determining a rate of decay of the difference; and calibrating the engine control module based on the rate of decay.

7. The method of claim 1, wherein the engine control module controls the amount of fuel based on a difference between a reference signal and signals received from the second oxygen sensor during operation of the engine.

8. The method of claim 7, wherein the reference signal indicates a desired composition of the exhaust gas at the second oxygen sensor.

9. The method of claim 8, wherein the reference signal indicates a stoichiometric ratio.

10. The method of claim 1, further comprising:

determining a plurality of the components during a period of operation of the engine; and calibrating the engine control module based on the plurality of the components.

11. The method of claim 10, wherein each of the plurality of the components is based on a rate of decay of the difference.

12. The method of claim 11, further comprising calibrating the engine control module using a model based calibration that includes the model of the catalyst.

13. The method of claim 1, further comprising predicting the response based on at least one of a temperature of the exhaust gas and a flow rate of the exhaust gas.

14. The method of claim 1, wherein the model predicts the response based on the first signal and at least one of a temperature of the exhaust gas and a flow rate of the exhaust gas.

15. A system for calibrating an engine control module, comprising:

a catalyst simulation module that:

samples a first signal from a first oxygen sensor located upstream from a catalyst, wherein the first signal indicates an oxygen content of exhaust gas produced by an engine; and predicts a response of a second oxygen sensor located downstream from the catalyst using a model of the catalyst and the first signal;

a component determination module that samples a second signal from the second oxygen sensor and that determines a component of the second signal based on a difference between samples of the second signal and the predicted response, wherein the component is due to gases other than oxygen; and a calibration module that calibrates the engine control module based on the component of the second signal, wherein the engine control module controls an amount of fuel injected into the engine.

16. The system of claim 15, wherein the gases other than oxygen include hydrogen gas.

17. The system of claim 16, wherein the hydrogen gas is released from the catalyst.

18. The system of claim 15, wherein the calibration module calibrates a control architecture of the engine control module, and wherein the control architecture includes at least one of proportional-integral-derivative (PID) control, gain-scheduled PID control, H-infinity control, sliding mode control (SMC), and fuzzy logic control.

19. The system of claim 15, wherein the component determination module determines a rate of decay of the difference and the calibration module calibrates the engine control module based on the rate of decay.

20. The system of claim 15, wherein the engine control module controls the amount of fuel based on a difference between a desired composition of the exhaust gas at the second oxygen sensor and signals received from the second oxygen sensor during operation of the engine.

* * * * *